US005443262A

United States Patent [19]

Weng

[11] Patent Number: 5,443,262

[45] Date of Patent: Aug. 22, 1995

[54] BASEBALL GAME

[76] Inventor: Walter A. Weng, 27 Clement St., Glen Cove, N.Y. 11542

[21] Appl. No.: 107,061

[22] Filed: Aug. 17, 1993

Related U.S. Application Data

[63] Continuation-in-part of Ser. No. 38,701, Mar. 29, 1993, abandoned.

[51] Int. Cl.[6] ..... A63F 7/06

[52] U.S. Cl. ..... 273/89; 273/129 S; 273/85 E

[58] Field of Search ..... 273/88, 89, 126 R, 129 S, 273/129 T, 129 V, 129 W, 90, 85 E, 85 F

[56] References Cited

U.S. PATENT DOCUMENTS

| | | | |
|---|---|---|---|
| 1,008,898 | 11/1911 | Fulton et al. | 273/89 |
| 1,122,141 | 12/1914 | McIlroy | 273/89 |
| 2,110,902 | 3/1938 | Bailey | 273/89 |
| 2,246,115 | 6/1941 | Volz | 273/89 |
| 2,382,329 | 8/1945 | Munro | 273/89 X |
| 2,588,972 | 3/1952 | Fish | 273/89 |
| 2,682,409 | 6/1954 | Irwin | 273/89 |
| 2,720,398 | 10/1955 | Andrews et al. | 273/129 S X |
| 3,656,753 | 4/1972 | Juneau | 273/129 S X |
| 4,251,074 | 2/1981 | Welker | 273/89 |
| 4,921,251 | 5/1990 | Kanenwisher | 273/93 R |

*Primary Examiner*—Sebastiano Passaniti
*Attorney, Agent, or Firm*—Philip Furgang

[57] ABSTRACT

An elongated drawer-like base is provided at one end with a batting plunger and a plurality of "strike" and "ball" simulated baseball retaining compartments and at an opposite end with a pitching plunger and a plurality of ball retaining compartments carrying "out", "single", "double", "triple" and "home-run" designations. A projection is carried by the pitching plunger to be received in a hole extending through a simulated baseball to facilitate pitching thereof. A pair of ball returns may be carried by the base on each side thereof and a transparent cover arrangement is formed in two halves each carried by the base. In one configuration the cover arrangement includes a pair of covers each hingedly mounted to the base to pivot open in opposite direction. In an alternative cover arrangement each cover is secured at an end of the base to extend over batting and pitching areas respectively but so as to be spaced from side of the base.

28 Claims, 2 Drawing Sheets

BASEBALL GAME

REFERENCE TO RELATED APPLICATIONS

This application is a continuation-in-part of my earlier filed application Ser. No. 08/038,701 filed Mar. 29, 1993 for BASEBALL GAME now abandoned.

BACKGROUND OF THE INVENTION-FIELD OF APPLICATION

This invention relates to simulated sports games; and more particularly to a game including devices and mechanisms for playing a simulated game of baseball.

BACKGROUND OF THE INVENTION-DESCRIPTION OF THE PRIOR ART

The patented literature is replete with descriptions and illustrations of sports amusement devices, mechanisms and games and especially such games, devices and mechanisms for playing a simulated game of baseball. However, the devices, mechanisms and games so shown and described in the patent literature: quite often lack relatively realistic versatility for playing the game of baseball; more often than not include relatively complex mechanisms to effect playing of the game; and generally do not protect the players from being struck by the projectile used to simulate the baseball while in play while at the same time facilitating game play without relatively complex game play devices and mechanisms.

For example, U.S. Pat. No. 2,026,791 granted on Jan. 7, 1936 to J. C. Mayer for "Baseball Game" and U.S. Pat. No. 2,482,083 granted on Sep. 13, 1949 to E. L. Whitehall for "Game Board" use hand held sticks to strike the simulated baseball which, due to the structure of these games might just as easily strike the opposing player as put the ball in play. Alternative configurations and arrangements of baseball games appear, for example, in: U.S. Pat. No. 1,030,664 granted on Jun. 25, 1912 to H. K. Kirch and O. E. Clauss for "Game Apparatus"; U.S. Pat. No. 1,122,141 granted on Dec. 22, 1914 to W. McIlroy for "Base Ball Game Apparatus"; U.S. Pat. No. 1,346,782 granted on Jul. 13, 1920 to W. G. Gehring for "Baseball Game"; U.S. Pat. No. 1,942,429 granted on Jan. 9, 1934 to H. F. Jacobs for "Miniature Baseball Game"; U.S. Pat. No. 2,382,329 granted on Aug. 14, 1945 to D. H. Munro for "Baseball Game"; U.S. Pat. No. 3,706,454 granted on Dec. 19, 1972 to J. Parlato for "Simulated Baseball Game"; and U.S. Pat. No. 3,879,037 granted on Apr. 22, 1975 to R. Cooke for "Simulated Baseball Game". But the Kirch et al, Jacobs, Parlato, and Cooke games unacceptably restrict either the movement of the pitching or batting mechanisms, or both, or channel the baseball projectile thus limiting the versatility of putting the ball in play. The Gehring game requires a relatively awkward rotary manipulation of stems extending through and below the game surface; while the McIlroy and Munro games place the simulated baseball in positions from which such items might be dislodged during game play but prior to being pitched towards the batter thus delaying and otherwise spoiling the game.

Yet further alternative baseball game constructions and arrangements are shown and described in: U.S. Pat. No. 1,703,009 granted on Feb. 19, 1929 to F. G. Kiesling for "Game"; U.S. Pat. No. 2,344,193 granted on Mar. 14, 1944 to G. F. Woodward for "Game Apparatus"; U.S. Pat. No. 3,224,772 granted on Dec. 21, 1965 to H. R. Wells et. al for "Baseball Game"; U.S. Pat. No. 3,705,723 granted on Dec. 12, 1972 to C. J. Eissler for "Baseball Game"; and in U.S. Pat. No. 3,709,494 granted on Jan. 9, 1973 to G. A. Barlow for "Baseball Game". The Wells et al and Barlow games, however, are unacceptable simulations of baseball play because the results of putting the ball in play each time are determined by a spinner and thus bears very little if any reality to a simulated baseball game; while Eissler's game uses a disc rolling down a ramp to simulate pitching a baseball and the Kiesling and Woodward games use trigger released catapult type mechanisms to pitch their baseballs thus denying the pitcher desired degrees of versatility. In the "Game" patented by B. A. Zick on Aug. 18, 1925 in U.S. Pat. No. 1,549,949 desired versatility in batting the pitched baseball is significantly and unacceptably reduced because the ball is to rebound off of an abutment block; while the "Game" patented by R. Davis on Feb. 4, 1941 in U.S. Pat. No. 2,230,743 utilizes an unbaseball like disc slid by a magnet in an unpitched-like manner, and the "Baseball Game" patented by R. R. Hefler on Mar. 27, 1984 in U.S. Pat. No. 4,438,927 bats down a baseball fixed to the end of a rod to complete electric circuitry in a simulation that is relatively distant from simulating a baseball game. U.S. Pat. No. 2,925,275 granted on Feb. 16, 1960 to A. Schlapa for "Simulated Baseball Game" and U.S. Pat. No. 2,841,398 granted on Jul. 1, 1958 to R. W. Conner for "Ball Game Apparatus" provide relatively complex simulated games utilizing light beams and projectors which can only result in relatively expensive games that may be financially out of the reach of persons who only want to enjoy a simulated baseball game.

SUMMARY OF THE INVENTION

It is therefore an object of this invention to provide a new and novel game apparatus.

It is another object of this invention to provide a new and novel simulated sports game.

It is yet another object of this invention to provide a new and novel simulated baseball game.

It is still another object of this invention to provide new and novel baseball launching mechanism for a simulated baseball game.

It is yet still another object of this invention to provide a new and novel playing field for a simulated baseball game.

It is a further object of this invention to provide a covering arrangement for a playing field for a simulated baseball game that provides protection for the players from being struck by the simulated baseball when in play while still facilitating a relatively easily and relatively low cost means for putting the simulated baseball in play.

It is still another object of this invention to provide a new and novel ball return arrangement for a simulated baseball game.

It is still a further object of this invention to provide a new and novel arrangement for displaying the results of putting the baseball in play for a simulated baseball game.

Other objects, features and advantages of the invention in its details of construction and arrangement of parts will be seen from the above and from the following description of the preferred embodiments when considered with the drawing and from the appended claims.

BRIEF DESCRIPTION OF THE PREFERRED EMBODIMENT

Figure 1:
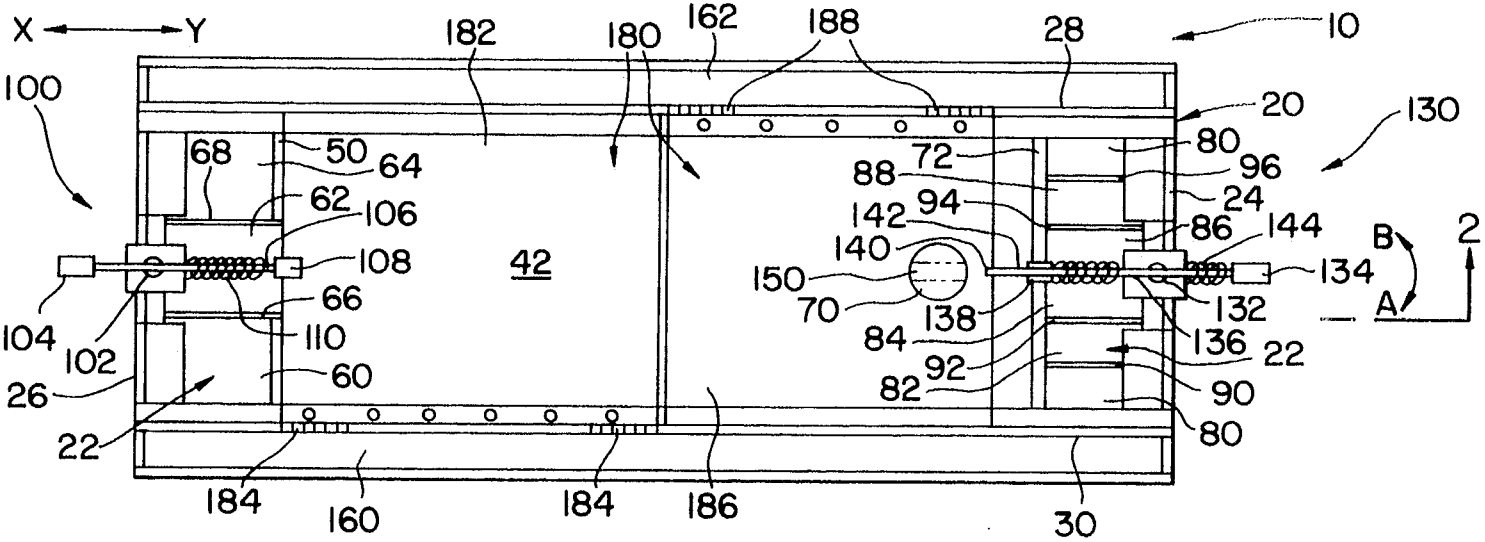
FIG. 1 is a plan view of a simulated baseball game apparatus incorporating the instant invention.
Figure 2:
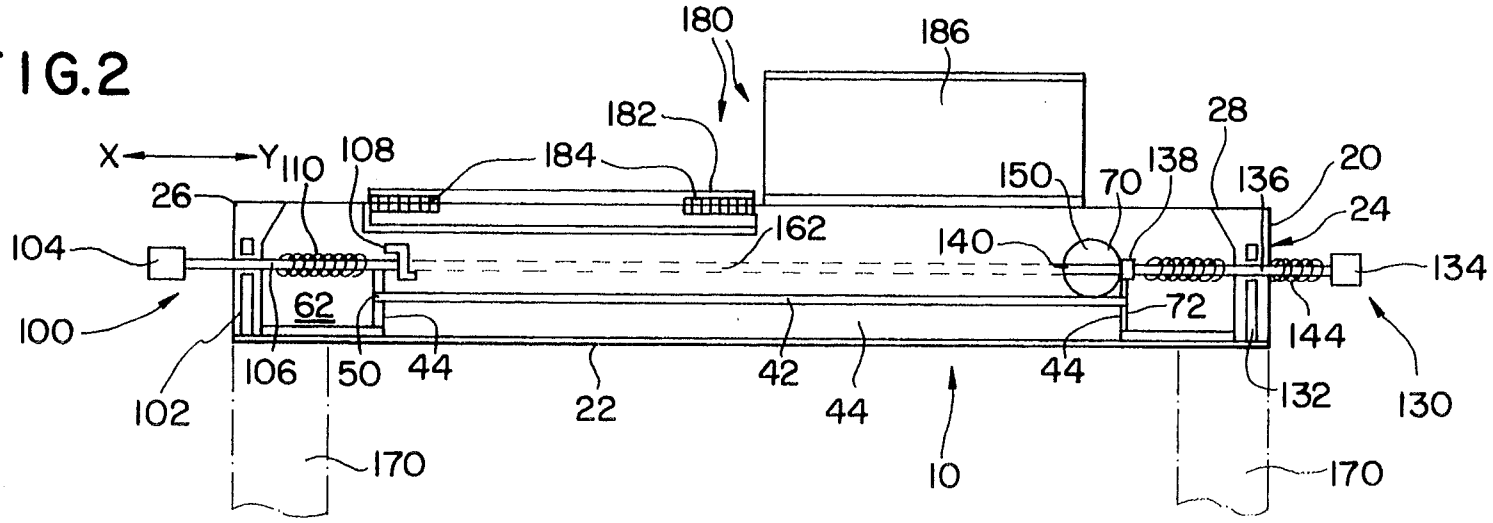
FIG. 2 is a side elevation view on line 2—2 of FIG. 1 of the simulated baseball game apparatus of FIG. 1 with a portion of the cover opened to better show details thereof.

With reference to FIGS. 1 and 2 there is generally shown at 10 a game apparatus for playing a simulated baseball game. Apparatus 10 includes a base 20 in the configuration of an elongated rectangular open top box or drawer having a bottom 22 a pair of oppositely disposed spaced end walls 24, 26 rising up from and connected to bottom 22 proximate its end edges by suitable and conventional means such as threaded fasteners, adhesive or the like, and a pair of oppositely disposed spaced side walls 28 and 30 (FIG. 1 only) also rising up from and connected to bottom 22 proximate its side edges by suitable and conventional means such as threaded fasteners, adhesive or the like. Base 20 may be fabricated from suitable materials such as wood, metal, plastic or the like; either in individual pieces as described above or as a unitary member as it might be if molded or otherwise formed from plastic.

A playing surface 42 is disposed above and generally spaced from an upper surface of bottom 22 by at least end supports 44 which rise up from bottom 22 spaced into base 20 from end walls 24, 26 respectively by predetermined distances for reasons to be hereinafter described. The sides of playing surface 42 may either be directly connected to side walls 28, 30 or they may be disposed upon side supports similar to end supports 44. Connection between playing surface 42 supports 44, bottom 22 and if so utilized side walls 28, 30 may be effected by suitable means such as threaded members, adhesive or the like; or if base 20 is a molded construction by suitable molding.

Playing surface 42 terminates at an end 50 proximate but spaced from end 26 of base 20 to define therebetween a batting location whereat there are disposed a number of ball receiving compartments or boxes 60, 62 and 64. A pair of walls 66, 68 separate boxes 60, 62 and 62, 64 respectively. All such boxes or compartments extend up from bottom 22 of base 20 so that the floor of the respective compartments 60–64 lie beneath playing surface 42 thus providing a place to trap and retain a projectile 70 in the configuration of a miniature baseball as will be hereinafter described. Compartments 60, 64 have been labeled "Ball" and compartment 62 has been labeled "Strike" to designate the result of the play should ball 70 end up disposed in the respective compartment. The size of compartments 60–64 is selected to correspond to the relative size of base 20 and ball 70. More or less compartments may be utilized and labeled or designated accordingly.

Playing surface 42 terminates at its other end 72 proximate but spaced from end 24 of base 20 to define therebetween a pitching location whereat there are disposed a number of additional compartments or boxes 80, 82, 84, 86, 88 and 80. Dividing walls 90, 92, 94, 96 separate boxes 80–82, 82–84, 86–88, and 88–80 respectively. Compartments or boxes 80–88 also extend up from bottom 22 of base 20 so that the floor of the respective compartments 80–88 lie beneath playing surface 42 thus providing a place to trap and retain baseball or projectile 70. Compartments 80 have been labeled or designated "Out" while 82, 84, 86 and 88 have been labeled or designated "1", "2", "3" and "4" respectively to indicate a "single", "double", "triple" and "home run". The size of compartments 80–88 is selected to correspond to the relative size of base 20 and ball 70. More or less compartments may be utilized and labeled or designated accordingly.

A batting plunger 100 is disposed at batting location proximate end 26 of base 20 so as to swivel (in the directions of arrows A and B) and slide (in the directions of arrow X and Y) upon a support rod 102 (FIG. 2) suitably mounted to bottom 22 of base 20. A knob 104 (FIGS. 1 and 2) is secured at one end of a shaft 106 of plunger 100 and a striker 108 is disposed at the other end of shaft 106. A spring 110 is disposed about shaft 106 between striker 108 and support rod 102. Plunger 100 is operated in substantially conventional manner by grasping knob 104 and drawing plunger 100 in the direction of arrow X to compress spring 110 between striker 108 and support rod 102. If needed plunger 100 may also be swiveled either in the direction of arrow A or arrow B. Upon release of knob 104 spring 110 moves striker 108 in the direction of arrow Y.

A pitching plunger 130 is disposed at pitching location proximate end 24 of base 20 so as to swivel (in the directions of arrows A and B) and slide (in the directions of arrow X and Y) upon a support rod 132 suitably mounted to bottom 22 of base 20. A knob 134 is secured at one end of a shaft 136 of plunger 130 and an abutment 138 is secured about shaft 136 at a selected distance in from an end 140 of shaft 136 to define a pitching end 142 for shaft 136. A spring 144 is disposed about shaft 136 between abutment 138 and support rod 132. Plunger 130 is operated in a manner similar to plunger 100 by drawing plunger 130 in the direction of arrow Y to compress spring 144 between abutment 138 and support rod 132. If desired plunger 130 may also be swiveled either in the direction of arrow A or arrow B. Upon release of knob 134 spring 144 moves shaft 136 in the direction of arrow X.

It should be noted that the projectile or simulated baseball 70 has formed therein a pitching opening 150 which preferably is a bore or hole extending through simulated baseball or game piece 70. Hole 70 is sized and configured to permit insertion therein of pitching end 142 of plunger 130 (FIG. 2) the two coacting to position ball 70 on plunger 130. If desired hole 150 need not extend completely through ball 70 but only thereinto an amount sufficient to mount ball 70 upon pitching end 142 of plunger 130. In any such instance ball 70 is to move with plunger 130 when plunger 130 is drawn in the direction of arrow Y and is to fit upon pitching end 142 so as to be projected therefrom when spring 144 drives shaft 136 abutment 138 and pitching end 142 and a ball 70 disposed thereon in the direction of arrow X.

The degree of force with which ball 70 is projected in the direction of arrow X and the degree of force with which ball 70 is struck by striker 108 (if so struck) may be controlled by the amount of compression applied to springs 144 and 110 respectively. Similarly the direction in which ball 70 is projected towards end 26 of base 20 and the direction in which ball 70 is struck and driven towards end 22 of base 20 to score a single, double, triple, or home run may be determined by the angle at which the respective plungers 130 and 100 respectively are positioned.

A ball return 160 (FIG. 1) is secured to the outside surface of side wall 30 and a similar ball return 162 is secured to the outside surface of side wall 28. Both ball returns 160, 162, slope slightly towards end wall 24 so that balls disposed therein will be near pitching plunger 130.

A cover 180 of transparent material which will resist breakage and shattering if struck by ball 70 is provided for game 20. A first cover-half 182 of cover 180 is secured by hinges 184 proximate end 26 of base 20 so as to span the tops of side walls 28, 30 thereof and so as to extend from proximate the center of base 20 towards end 26 but so as to terminate proximate end 50 of playing surface 44. A second cover half 186 of cover 180 is secured by hinger 188 (FIG. 1) proximate end 24 of base 20 so as to span the tops of side walls 28, 30 thereof and so as to extend from proximate the center of game 20 towards end 24 but so as to terminate proximate pitching end 142 of plunger 130. Thus cover halfs 182, 186 when lowered substantially cover playing surface 42 so that ball 70 when pitched or struck will stay within base 20 and not strike a player, observer or otherwise leave base 20. When placing a ball on pitching end 142 of plunger 130 the player may either rotate cover 186 by its hinges to lift cover 186 sufficient to place ball 70 on end 142 or the player may do so, if possible, without so lifting cover-half 186.

The game is played by placing hole 150 of ball 70 about pitching end 142 of plunger 130 and thereafter operating plunger 130, as hereinabove described, to project ball 70 with the desired force and angle towards batting plunger 100. Ball 70 stays positioned on pitching plunger 130 because it is penetrated by pitching end 142 but leaves pitching plunger 130 due to the action of spring 144. The batter operates batting plunger 100 to intercept ball 70 and drive it towards the desired hit. Balls 70 that are missed will fall into either "ball" compartments 60, 64 or "strike" compartment 62; while balls 70 that are struck by striker 108 will be driven into compartments 80–88. The scoring continues as in regular baseball or as the player's may select until an inning is over at which time the player's change sides. Before the start of each inning balls 70 in compartments 80–88 are removed from compartments 80–88 and may, if desired, be stored in ball returns 160, 162 proximate pitching end 24 and ball 70 that may be in compartments 60–64 are removed therefrom and placed in ball returns 160, 162 where they roll to pitching end 24. The termination of cover-halfs 182, 186 short of end walls 24, 26 facilitate ready removal of balls 70 from compartments 60–64 and 80–88 without lifting cover-halfs 182, 186. If desired cover-halfs 180, 186 may extend to ends 24, 26 respectively and would then have to be lifted to retrieve ball 70.

Base 20 may be placed upon a table or the like at an appropriate height to play the simulated baseball game, or upon saw horses, or chairs or any suitable supports. Alternatively legs, such as legs 170 shown in phantom in FIG. 2 may be provided to support base 20.

Figure 3:
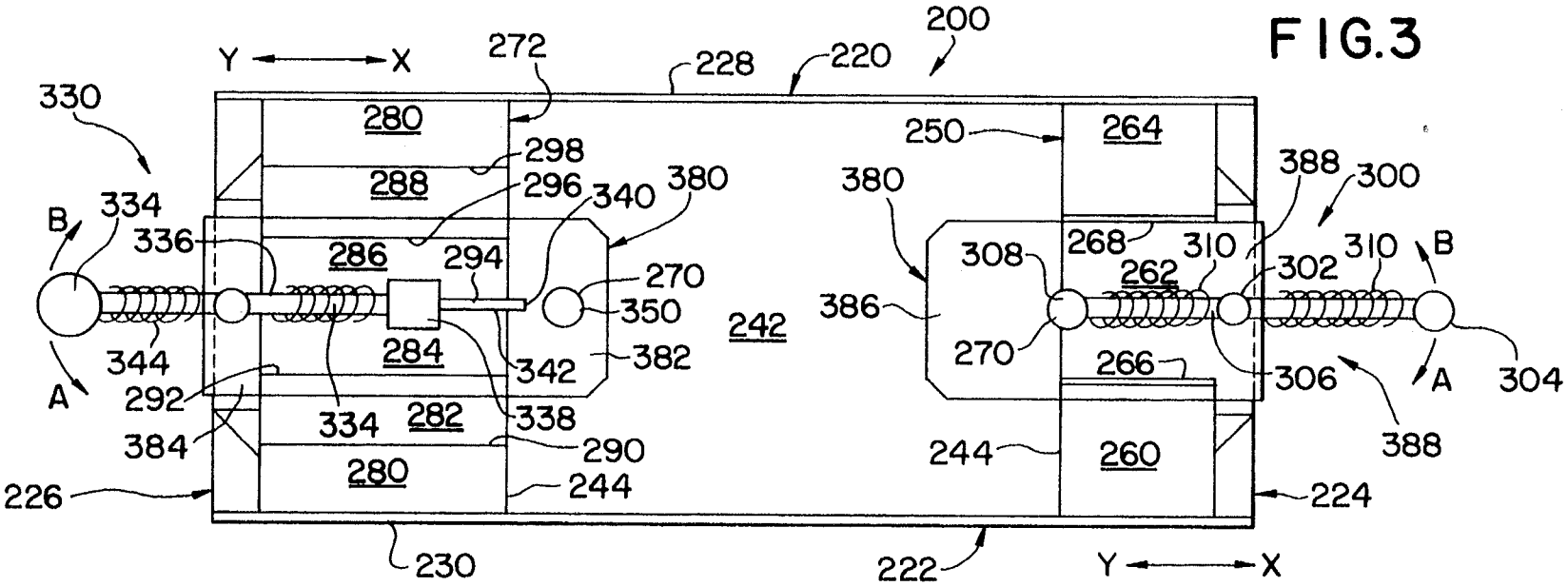
FIG. 3 is a plan view of an alternative embodiment of a simulated baseball game apparatus incorporating the instant invention.
Figure 4:
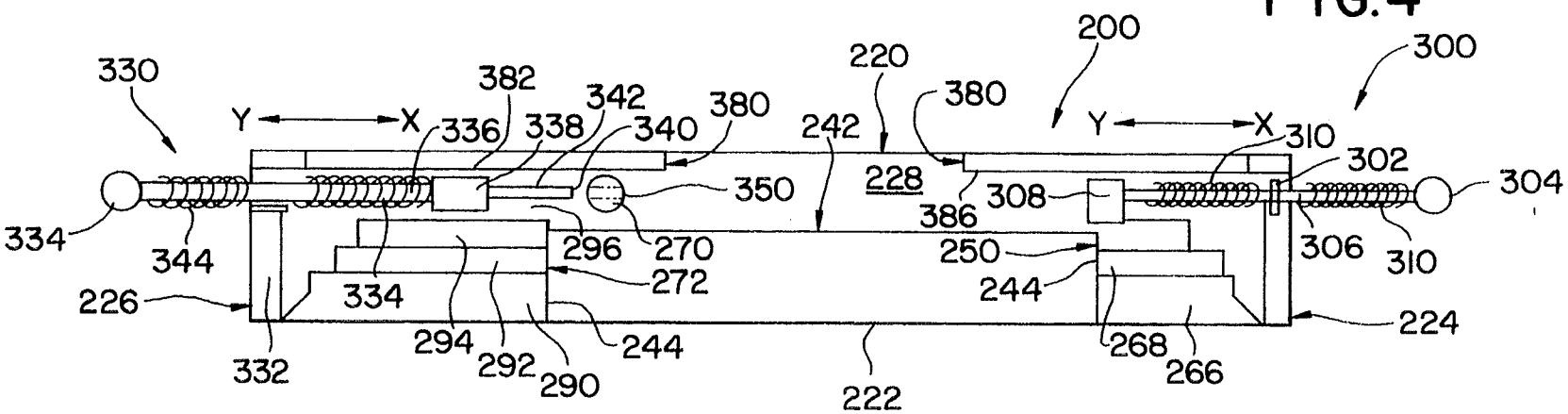
FIG. 4 is a side elevation section view of the simulated baseball game apparatus of FIG. 3.

With reference to FIGS. 3 and 4 there is generally shown at 200 an alternative embodiment of a game apparatus for playing a simulated baseball game. Apparatus 200 includes a base 220 in the configuration of an elongated rectangular open top box or drawer having a bottom 222 a pair of oppositely disposed spaced end walls 224, 226 rising up from and connected to bottom 222 proximate its end edges by suitable and conventional means such as threaded fasteners, adhesive or the like, and a pair of oppositely disposed spaced side walls 228 and 230 (FIG. 3 only) also rising up from and connected to bottom 222 proximate its side edges by suitable and conventional means such as threaded fasteners, adhesive or the like. Base 220 may be fabricated from suitable materials such as wood, metal, plastic or the like; either in individual pieces as described above or as a unitary member as it might be if molded or otherwise formed from plastic.

A playing surface 242 is disposed above and generally spaced from an upper surface of bottom 222 by at least end supports 244 which rise up from bottom 222 spaced into base 220 from end walls 224, 226 respectively by predetermined distances for reasons to be hereinafter described. The sides of playing surface 242 may either be directly connected to side walls 228, 230 or they may be disposed upon side supports similar to end supports 244. Connection between playing surface 242 supports 244, bottom 222 and if so utilized side walls 228, 230 may be effected by suitable means such as threaded members, adhesive or the like; or if base 220 is a molded construction by suitable molding.

Playing surface 242 terminates at an end 250 proximate but spaced from end 224 of base 220 to define therebetween a batting location whereat there are disposed a number of ball receiving compartments or boxes 260, 262 and 264. A pair of walls 266, 268 separate boxes 260, 262 and 262, 264 respectively. All such boxes or compartments extend up from bottom 222 of base 220 so that the floor of the respective compartments 260–264 lie beneath playing surface 242 thus providing a place to trap and retain a projectile 270 in the configuration of a miniature baseball as will be hereinafter described. Compartments 260, 264 are preferably labeled "Ball" and compartment 262 may be preferably labeled "Strike" to designate the result of the play should ball 270 end up disposed in the respective compartment. The size of compartments 260–264 is selected to correspond to the relative size of base 220 and ball 270. More or less compartments may be utilized and labeled or designated accordingly.

Playing surface 242 terminates at its other end 272 proximate but spaced from end 226 of base 220 to define therebetween a pitching location whereat there are disposed a number of additional compartments or boxes 280, 282, 284, 286, 288 and 280. Dividing walls 290, 292, 294, 296, 298 separate boxes 280–282, 282–284, 284–286, 286–288, and 288–280 respectively. Compartments or boxes 280–288 also extend up from bottom 222 of base 220 so that the floor of the respective compartments 280–288 lie beneath playing surface 242 thus providing a place to trap and retain baseball or projectile 270. Compartments 280 may be labeled or designated "Out" while 282, 284, 286 and 288 may be labeled or designated "1", "2", "3" and "4" respectively to indicate a "single", "double", "triple" and "home run". The size of compartments 280–288 is selected to correspond to the relative size of base 220 and ball 270. More or less compartments may be utilized and labeled or designated accordingly.

A batting plunger 300 is disposed at batting location proximate end 224 of base 220 so as to swivel (in the directions of arrows A and B) and slide (in the directions of arrow X and Y) upon a support rod 302 (FIG. 2) suitably mounted to bottom 222 of base 220. A knob 304 (FIGS. 3 and 4) is secured at one end of a shaft 306 of plunger 300 and a striker 308 is disposed at the other end of shaft 306. A spring 310 is disposed about shaft 306 between striker 308 and support rod 302. Plunger 300 is operated in substantially conventional manner by grasping knob 304 and drawing plunger 300 in the direction of arrow X to compress spring 310 between striker 308 and support rod 302. If needed plunger 300 may also be swiveled either in the direction of arrow A or arrow B. Upon release of knob 304 spring 310 moves striker 308 in the direction of arrow Y.

A pitching plunger 330 is disposed at pitching location proximate end 226 of base 220 so as to swivel (in the directions of arrows A and B) and slide (in the directions of arrow X and Y) upon a support rod 332 suitably mounted to bottom 222 of base 220. A knob 334 is secured at one end of a shaft 336 of plunger 330 and an abutment 338 is secured about shaft 336 at a selected distance in from an end 340 of shaft 336 to define a pitching end 342 for shaft 336. A spring 344 is disposed about shaft 336 between abutment 338 and support rod 332. Plunger 330 is operated in a manner similar to plunger 300 by drawing plunger 330 in the direction of arrow Y to compress spring 344 between abutment 338 and support rod 332. If desired plunger 330 may also be swiveled either in the direction of arrow A or arrow B. Upon release of knob 334 spring 344 moves shaft 336 in the direction of arrow X.

It should be noted that the projectile or simulated baseball 270 has formed therein a pitching opening 350 which preferably is a bore or hole extending through simulated baseball or game piece 270. Hole 350 is sized and configured to permit insertion therein of pitching end 342 of plunger 330 (FIG. 2) the two coacting to position ball 270 on plunger 330. If desired hole 350 need not extend completely through ball 270 but only thereinto an amount sufficient to mount ball 270 upon pitching end 342 of plunger 330. In any such instance ball 270 is to move with plunger 330 when plunger 330 is drawn in the direction of arrow Y and is to fit upon pitching end 342 so as to be projected therefrom when spring 344 drives shaft 336 abutment 338 and pitching end 342 and a ball 270 disposed thereon in the direction of arrow X.

The degree of force with which ball 270 is projected in the direction of arrow X and the degree of force with which ball 270 is struck by striker 308 (if so struck) may be controlled by the amount of compression applied to springs 344 and 310 respectively. Similarly the direction in which ball 270 is projected towards end 224 of base 220 and the direction in which ball 270 is struck and driven towards end 226 of base 220 to score a single, double, triple, or home run may be determined by the angle at which the respective plungers 330 and 300 respectively are positioned.

A ball return as shown for the embodiment of FIGS. 1 and 2 may be similarly secured to the outside surface of side wall 230 and a similar ball return may similarly secured to the outside surface of side wall 228. Both ball returns would slope slightly towards end wall 226 so that balls disposed therein will be near pitching plunger 330.

Covers 380 of transparent material which will resist breakage and shattering if struck by ball 270 are provided for game 200. A first cover-half 382 of covers 380 is secured by threaded members 384 or the like proximate end 226 of base 220 so as to cover the area of game 200 proximate where plunger 330 is to pitch ball 270. A second cover-half 386 of covers 380 is secured by threaded members 388 or the like (FIG. 3) proximate end 224 of base 220 so as to cover the area of game 200 proximate where plunger 300 is to strike a pitched ball 270. Thus cover halfs 382, 386 cover areas of playing surface 242 so that ball 270 when pitched or struck will stay within base 220 and not strike a player, observer or otherwise leave base 220. When placing a ball on pitching end 342 of plunger 330 one need merely reach below cover half 382 and place ball 270 on end 342.

Game 200 is played similar to game 10 of the embodiment of FIGS. 1-2 by placing hole 350 of ball 270 about pitching end 342 of plunger 330 and thereafter operating plunger 330, as hereinabove described, to project ball 270 with the desired force and angle towards batting plunger 300. Ball 270 stays positioned on pitching plunger 330 because it is penetrated by pitching end 342 but leaves pitching plunger 330 due to the action of spring 344. The batter operates batting plunger 300 to intercept ball 270 and drive it towards the desired hit. Balls 270 that are missed will fall into either "ball" compartments 260, 264 or "strike" compartment 262; while balls 270 that are struck by striker 308 will be driven into compartments 280-288. The scoring continues as in regular baseball or as the player's may select until an inning is over at which time the player's change sides. Before the start of each inning balls 270 in compartments 280-288 are removed from compartments 280-288 and may, if desired, be stored in the ball returns proximate pitching end 226 and balls 270 that may be in compartments 260-264 are removed therefrom and placed in the ball returns where they roll to pitching end 226. The termination of cover-halfs 382, 386 short of side walls 228, 230 facilitate ready removal of balls 270 from compartments 260-264 and 280-288.

Base 220 may be placed upon a table or the like at an appropriate height to play the simulated baseball game, or upon saw horses, or chairs or any suitable supports. Alternatively legs, may be provided to support base 220.

It is understood that although I have shown the preferred embodiment of my invention that various modifications may be made in the details thereof without departing from the spirit as comprehended by the following claims.

What is claimed is:

1. A simulated baseball game; comprising:

(a) base means defining a space within which the simulated baseball game is to be played;

(b) said base means including a pitching location and a batting location disposed one opposite the other;

(c) pitching means disposed at said pitching location for projecting a simulated baseball towards said batting location;

(d) batting means disposed at said batting location for intercepting a pitched simulated baseball and driving said pitched simulated baseball in a predetermined direction;

(e) said pitching means carrying a retaining rod for retaining a simulated baseball on said pitching means to facilitate projecting of the simulated baseball; and (f) at least one simulated baseball means, for use in playing the simulated baseball game, formed with an opening of a size and configuration to receive said retaining rod;

(g) said base means including a plurality of compartments disposed proximate said batting location and designated to correspond to balls and strikes and a plurality of compartments disposed proximate said pitching location designated to correspond to hits and outs.

2. The simulated baseball game of claim 1, wherein said opening extends through said simulated baseball means and said rod-like piece is sized to extend into substantially the entire extent of said opening.

3. The simulated baseball game of claim 2, wherein said pitching means includes a plunger that compresses a spring when drawn in a first direction and which is actuated by said spring when released.

4. The simulated baseball game of claim 1, wherein said base means is generally in the configuration of an elongated rectangular box or drawer open at its top and surrounded by walls.

5. The simulated baseball game of claim 1, including at least one ball return carried along a side of said base means.

6. A simulated baseball, comprising:

(a) base means generally in the configuration of an elongated rectangular box or drawer open at its top and surrounded by walls defining a space within which the simulated baseball game is to be played;

(b) said base means including a pitching location disposed at one end of said base means and a batting location disposed at an opposite end of said base means;

(c) said base means including a plurality of compartments disposed at said end of said base means proximate said batting location designated to correspond to balls and strikes and a plurality of compartments disposed at said end of said base means proximate said pitching location designated to correspond to hits and outs;

(d) pitching means disposed at said pitching location for projecting a simulated baseball towards said batting location;

(e) batting means disposed at said batting location for intercepting a pitched simulated baseball and driving said pitched simulated baseball in a predetermined direction;

(f) said pitching means including retaining means for retaining a simulated baseball on said pitching means to facilitate projecting of the simulated baseball; and (g) at least one simulated baseball means for use in playing the simulated baseball game.

7. A simulated baseball game, comprising:

(a) base means defining a space within which the simulated baseball game is to be played;

(b) said base means including a pitching location and a batting location disposed one opposite the other;

(c) pitching means disposed at said pitching location for projecting a simulated baseball towards said batting location;

(d) batting means disposed at said batting location for intercepting a pitched simulated baseball and driving said pitched simulated baseball in a predetermined direction;

(e) said pitching means including retaining means for retaining a simulated baseball on said pitching means to facilitate projecting of the simulated baseball;

(f) at least one simulated baseball means for use in playing the simulated baseball game;

(g) transparent cover means for covering only selected areas of said base means.

8. A simulated baseball game, comprising:

(a) base means defining a space within which the simulated baseball game is to be played;

(b) said base means including a pitching location and a batting location disposed one opposite the other;

(c) pitching means disposed at said pitching location for projecting a simulated baseball towards said batting location;

(d) batting means disposed at said batting location for intercepting a pitched simulated baseball and driving said pitched simulated baseball in a predetermined direction;

(e) said pitching means including retaining means for retaining a simulated baseball on said pitching means to facilitate projecting of the simulated baseball;

(f) at least one simulated baseball means for use in playing the simulated baseball game;

(g) transparent cover means for covering at least selected areas of said base means;

(h) said transparent cover means being divided into a pair of transparent cover-halfs each mounted to said base means.

9. The simulated baseball game of claim 8, wherein a first one of said cover-halfs extends in a first direction and is disposed proximate said batting location and a second one of said cover-halfs extends in a second direction and is disposed proximate said pitching location.

10. The simulated baseball game of claim 9, wherein each cover-half is of a size and configuration so as to have respective ends thereof spaced from each other.

11. The simulated baseball game of claim 10, wherein each cover-half is of a size and configuration so that respective sides of each said cover-half are spaced from inner surfaces of said base means.

12. The simulated baseball game of claim 9, wherein each of said cover-halfs is pivotally mounted to said base means so as to open to facilitate game play.

13. The simulated baseball game of claim 12, wherein each of said cover-halfs is hingedly mounted.

14. The simulated baseball game of claim 13, wherein a first one of said cover-halfs extends in a first direction and is disposed proximate said batting location and a second one of said cover-halfs extends in a second direction and is disposed proximate said pitching location.

15. A baseball game, comprising:

(a) a base upon which a baseball game may be played;

(b) a pitching location carried by said base and a batting location carried by said base and disposed opposite the pitching location;

(c) a pitching device carried by said base for pitching a baseball towards said batting location;

(d) a batting device carried by said base for hitting the pitched baseball and driving said base ball towards said pitching location;

(e) a ball carrying rod carried by said pitching device; and (f) at least one baseball sized and configured for use in playing the baseball game and formed with an opening extending through said baseball to receive said ball carrying rod;

(g) said ball carrying rod being sized to extend into substantially the entire extent of said baseball opening;

(h) said base including a plurality of compartments disposed proximate said batting location and designated to correspond to balls and strikes and a plurality of compartments disposed proximate said pitching location designated to correspond to hits and outs.

16. The baseball game of claim 15, wherein said pitching device includes a plunger that compresses a spring when drawn in a first direction and which is actuated by said spring when released.

17. The baseball game of claim 15, wherein said base is generally in the configuration of an elongated rectangular box or drawer open at its top and surrounded by walls.

18. A baseball game, comprising:

(a) a base in the configuration of an elongated rectangular box or drawer open at its top and surrounded by walls and upon which a baseball game may be played;

(b) a pitching location carried by said base and disposed at one end thereof and a batting location carried by said base and disposed at an end of said base opposite said pitching location;

(c) a pitching device carried by said base for pitching a baseball towards said batting location;

(d) a batting device carried by said base for hitting the pitched baseball and driving said baseball towards said pitching location;

(e) a ball carrying rod carried by said pitching device; and (f) at least one baseball sized and configured for use in playing the baseball game;

(g) a plurality of compartments disposed at said end of said base proximate said batting locating and designated to correspond to balls and strikes and a plurality of compartments disposed at said end of said base proximate said pitching location and designated to correspond to bits and outs.

19. A baseball game, comprising:

(a) a base upon which a baseball game may be played;

(b) a pitching location carried by said base and a batting location carried by said base and disposed opposite the pitching location;

(c) a pitching device carried by said base for pitching a baseball towards said batting location;

(d) a batting device carried by said base for hitting the pitched baseball and driving said baseball towards said pitching location;

(e) a ball carrying rod carried by said pitching device;

(f) at least one baseball sized and configured for use in playing the baseball game; and (g) at least one ball return carried along a side of said base to return baseballs towards said pitching location.

20. The baseball game of claim 19, including a ball return carried along each side of opposed sides of said base.

21. A baseball game, comprising:

(a) a base upon which a baseball game may be played;

(b) a pitching location carried by said base and a batting locating carried by said base and disposed opposite the pitching location;

(c) a pitching device carried by said base for pitching a baseball towards said batting location;

(d) a batting device carried by said base for hitting the pitched baseball and driving said baseball towards said pitching location;

(e) a ball carrying rod carried by said pitching device;

(f) at least one baseball sized and configured for use in playing the baseball game; and (g) a ball return carried along each side of opposed sides of said base; and (h) a transparent cover means covering only selected areas of said base.

22. A baseball game, comprising:

(a) a base upon which a baseball game may be played;

(b) a pitching location carried by said base and a batting location carried by said base and disposed opposite the pitching location;

(c) a pitching device carried by said base for pitching a baseball towards said batting location;

(d) a batting device carried by said base for hitting the pitched baseball and driving said baseball towards said pitching location;

(e) a ball carrying rod carried by said pitching device;

(f) at least one baseball sized and configured for use in playing the baseball game; and (g) a ball return carried along each side of opposed sides of said base; and (h) transparent cover means for covering at least selected areas of said base;

(i) said transparent cover means being divided into a pair of transparent cover halfs each hingedly mounted to said base.

23. The baseball game of claim 22, wherein a first one of said cover-halfs extends in a first direction and is disposed proximate said batting location and a second one of said cover-halfs extends in a second direction and is disposed proximate said pitching location.

24. The simulated baseball game of claim 23, wherein each cover-half is of a size and configuration so as to have respective ends thereof spaced from each other.

25. The simulated baseball game of claim 24, wherein each cover-half is of a size and configuration so that respective sides of each said cover-half are spaced from inner surfaces of said base means.

26. The simulated baseball game of claim 23, wherein each of said cover-halfs is pivotally mounted to said base means so as to open to facilitate game play.

27. The simulated baseball game of claim 26, wherein each of said cover-halfs is hingedly mounted.

28. The simulated baseball game of claim 27, wherein a first one of said cover-halfs extends in a first direction and is disposed proximate said batting location and a second one of said cover-halfs extends in a second direction and is disposed proximate said pitching location.

* * * * *